US009238977B2

(12) United States Patent
Albers et al.

(10) Patent No.: US 9,238,977 B2
(45) Date of Patent: Jan. 19, 2016

(54) TURBINE SHROUD MOUNTING AND SEALING ARRANGEMENT

(71) Applicant: General Electric Company, Schenectady, NY (US)

(72) Inventors: Joseph Charles Albers, Fort Wright, KY (US); Robert Proctor, West Chester, OH (US); Monty Lee Shelton, Loveland, OH (US); Richard Russo, Jr., Windham, NH (US)

(73) Assignee: General Electric Company, Schenectady, NY (US)

( * ) Notice: Subject to any disclaimer, the term of this patent is extended or adjusted under 35 U.S.C. 154(b) by 373 days.

(21) Appl. No.: 13/683,813

(22) Filed: Nov. 21, 2012

(65) Prior Publication Data

US 2014/0140833 A1 May 22, 2014

(51) Int. Cl.

| | |
|---|---|
| ***F01D 25/28*** | (2006.01) |
| ***F01D 5/12*** | (2006.01) |
| ***F01D 5/22*** | (2006.01) |
| ***F01D 11/12*** | (2006.01) |

(52) U.S. Cl.

CPC *F01D 25/28* (2013.01); *F01D 5/12* (2013.01); *F01D 5/225* (2013.01); *F01D 11/122* (2013.01); *F01D 11/127* (2013.01)

(58) Field of Classification Search

CPC ..... F01D 5/12; F01D 5/225
USPC ..... 415/170.1, 173.1, 173.4–173.6, 174.4, 415/174.5, 189, 190
See application file for complete search history.

(56) References Cited

U.S. PATENT DOCUMENTS

| | | | | |
|---|---|---|---|---|
| 4,512,712 | A | | 4/1985 | Baran |
| 4,669,955 | A | | 6/1987 | Pellow |
| 4,863,345 | A | | 9/1989 | Thompson et al. |
| 5,188,507 | A | * | 2/1993 | Sweeney ..... 415/173.1 |
| 5,192,185 | A | | 3/1993 | Leonard |
| 5,232,340 | A | | 8/1993 | Morgan |
| 5,738,490 | A | | 4/1998 | Pizzi |

(Continued)

FOREIGN PATENT DOCUMENTS

| | | |
|---|---|---|
| CN | 1219215 A | 6/1999 |
| CN | 1532376 A | 9/2004 |

(Continued)

OTHER PUBLICATIONS

Search Report from PCT/US2013/064916 dated Mar. 12, 2014.

(Continued)

*Primary Examiner* — Igor Kershteyn
*Assistant Examiner* — Woody A Lee, Jr.
(74) *Attorney, Agent, or Firm* — General Electric Company; William Scott Andes

(57) ABSTRACT

A turbine shroud apparatus for a gas turbine engine having a centerline axis includes: a shroud segment having: an arcuate body extending axially between forward and aft ends and laterally between opposed end faces, wherein each of the end faces includes seal slots formed therein; and an arcuate stationary seal member mounted to the body; a turbine vane disposed axially aft of the shroud segment; and a casing surrounding the shroud segment and the turbine vane; wherein the turbine vane is mounted to the case so as to bear against the stationary seal member, compressing it and forcing the shroud segment radially outward against the casing.

14 Claims, 4 Drawing Sheets

(56) References Cited

U.S. PATENT DOCUMENTS

| | | | | |
|---|---|---|---|---|
| 5,927,942 | A | 7/1999 | Stahl et al. | |
| 6,062,813 | A | 5/2000 | Halliwell et al. | |
| 6,340,285 | B1 | 1/2002 | Gonyou et al. | |
| 6,341,938 | B1 | 1/2002 | Zegarski et al. | |
| 6,468,026 | B1 | 10/2002 | Bonnoitt et al. | |
| 6,814,538 | B2 | 11/2004 | Thompson | |
| 6,902,371 | B2 * | 6/2005 | Anderson et al. | 415/115 |
| 7,147,429 | B2 | 12/2006 | Czachor et al. | |
| 7,186,078 | B2 * | 3/2007 | Tanaka | 415/170.1 |
| 7,377,742 | B2 | 5/2008 | Shapiro et al. | |
| 8,740,552 | B2 | 6/2014 | Marusko et al. | |
| 8,753,073 | B2 | 6/2014 | Albers et al. | |
| 2005/0002779 | A1 | 1/2005 | Tanaka | |
| 2005/0002780 | A1 | 1/2005 | Tanaka | |
| 2005/0004810 | A1 * | 1/2005 | Tanaka | 705/1 |
| 2007/0231132 | A1 * | 10/2007 | Durand et al. | 415/209.2 |
| 2009/0269188 | A1 | 10/2009 | Martin | |
| 2010/0247298 | A1 | 9/2010 | Nakamura et al. | |

FOREIGN PATENT DOCUMENTS

| | | | |
|---|---|---|---|
| EP | 1132576 | A2 | 9/2001 |
| EP | 1890008 | A2 | 2/2008 |

OTHER PUBLICATIONS

Unofficial English Translation of Chinese Office Action issued in connection with corresponding CN Application No. 201380060905.1 on Oct. 28, 2015.

* cited by examiner

TURBINE SHROUD MOUNTING AND SEALING ARRANGEMENT

BACKGROUND OF THE INVENTION

This invention relates generally to gas turbine engine turbines and more particularly to apparatus for sealing turbine sections of such engines.

A gas turbine engine includes a turbomachinery core having a high pressure compressor, a combustor, and a high pressure turbine in serial flow relationship. The core is operable in a known manner to generate a primary gas flow. In a turbojet or turbofan engine, the core exhaust gas is directed through an exhaust nozzle to generate thrust.

A turbofan engine uses a low pressure turbine downstream of the core to extract energy from the primary flow to drive a fan which generates propulsive thrust. The low pressure turbine includes annular arrays of stationary vanes or nozzles that direct the gases exiting the combustor into rotating blades or buckets. Collectively one row of nozzles and one row of blades make up a "stage". Typically two or more stages are used in serial flow relationship.

These components operate in a high temperature environment. Nearby components outside the gas flow path (such as casings) must be protected from the high temperatures to ensure adequate service life. Leakage of flowpath gases between components, for example between turbine rotor shrouds and adjacent turbine nozzles, is therefore undesirable. Prior art designs have attempted to minimize the leakage gap through the compression of the honeycomb on the shroud. While somewhat effective this does not completely prevent leakage.

Accordingly, there is a need for a turbine shroud configuration that prevents leakage between the shroud and adjacent components.

BRIEF SUMMARY OF THE INVENTION

This need is addressed by the present invention, which provides a turbine shroud which is mounted with a combination of compressed honeycomb seals and spline seals to prevent leakage.

According to one aspect of the invention, a turbine shroud apparatus for a gas turbine engine having a centerline axis includes: a shroud segment having: an arcuate body extending axially between forward and aft ends and laterally between opposed end faces, wherein each of the end faces includes seal slots formed therein; and an arcuate stationary seal member mounted to the body; a turbine vane disposed axially aft of the shroud segment; and a casing surrounding the shroud segment and the turbine vane; wherein the turbine vane is mounted to the case so as to bear against the stationary seal member, compressing it and forcing the shroud segment radially outward against the casing.

According to another aspect of the invention, a turbine shroud apparatus for a gas turbine engine having a centerline axis includes: an annular array of rotatable turbine blades, each blade having an annular seal tooth projecting radially outward therefrom; a shroud surrounding the turbine blades, the shroud comprising an annular array of side-by-side shroud segments, each shroud segment having: an arcuate body extending axially between forward and aft ends and laterally between opposed end faces, wherein each of the end faces includes seal slots formed therein; and an arcuate stationary seal member mounted to the body, wherein the end faces of adjacent shroud segments abut each other and at least one spline seal is received in the seal slots so as to span the gap between adjacent shroud segments; an annular array of airfoil-shaped turbine vanes disposed axially aft of the shroud; and a casing surrounding the shroud segments and the turbine vanes; wherein each of the turbine vanes is mounted to the case so as to bear against one of the stationary seal members, compressing the seal member and forcing the associated shroud segment radially outward against the casing.

BRIEF DESCRIPTION OF THE DRAWINGS

The invention may be best understood by reference to the following description taken in conjunction with the accompanying drawing figures in which.

DETAILED DESCRIPTION OF THE INVENTION

Figure 1:
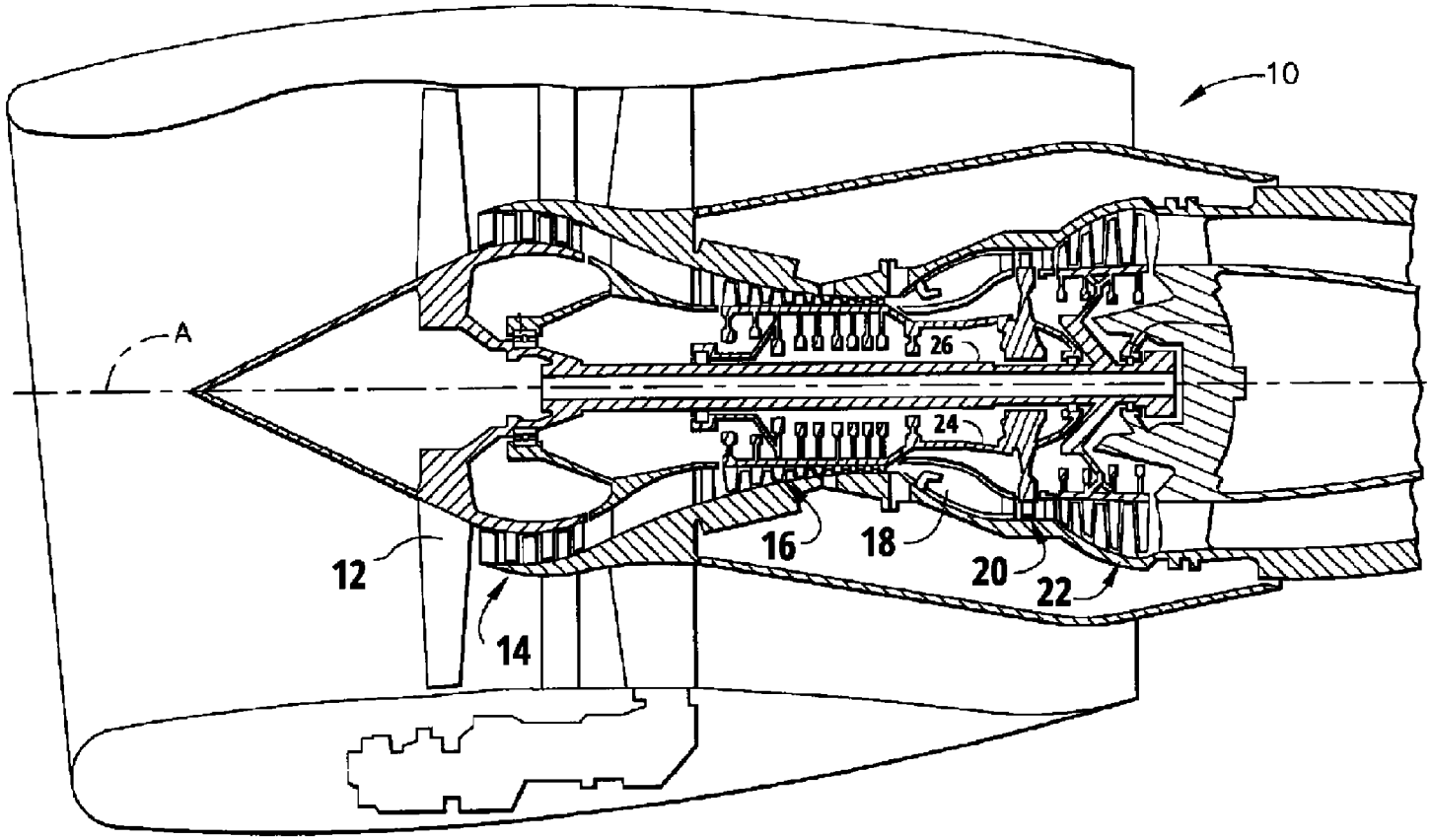
FIG. 1 a schematic cross-sectional view of a gas turbine engine constructed in accordance with the present invention.
Figure 2:
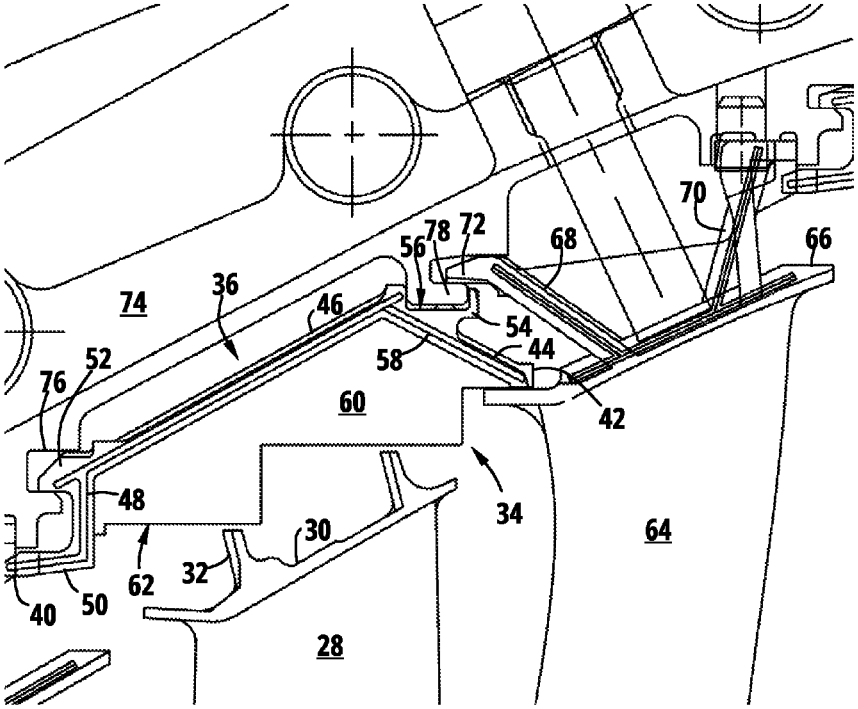
FIG. 2 is an enlarged view of a portion of a turbine section of the engine shown in FIG. 1.

Referring to the drawings wherein identical reference numerals denote the same elements throughout the various views, FIGS. 1 and 2 depict a portion of a gas turbine 10 engine having, among other structures, a fan 12, a low-pressure compressor or "booster" 14, a high-pressure compressor 16, a combustor 18, a high-pressure turbine 20, and a low-pressure turbine 22. The high-pressure compressor 16 provides compressed air that passes primarily into the combustor 18 to support combustion and partially around the combustor 18 where it is used to cool both the combustor liners and turbomachinery further downstream. Fuel is introduced into the forward end of the combustor 18 and is mixed with the air in a conventional fashion. The resulting fuel-air mixture is ignited for generating hot combustion gases. The hot combustion gases are discharged to the high pressure turbine 20 where they are expanded so that energy is extracted. The high pressure turbine 20 drives the high-pressure compressor 16 through an outer shaft 24. The gases exiting the high-pressure turbine 20 are discharged to the low-pressure turbine 22 where they are further expanded and energy is extracted to drive the booster 14 and fan 12 through an inner shaft 26.

In the illustrated example, the engine is a turbofan engine. However, the principles described herein are equally applicable to turboprop, turbojet, and turbofan engines, as well as turbine engines used for other vehicles or in stationary applications.

The low pressure turbine 22 includes a rotor carrying a array of airfoil-shaped turbine blades 28 extending outwardly from a disk that rotates about a centerline axis "A" of the engine 10. As seen in FIG. 2, the tip 30 of each blade 28 has one or more annular, flange-like seal teeth 32 extending radially outward therefrom. A plurality of shroud segments 34 are arranged in an annulus so as to closely surround the turbine blades 28 and thereby define the outer radial flowpath boundary for the hot gas stream flowing through the rotor.

Figure 3:
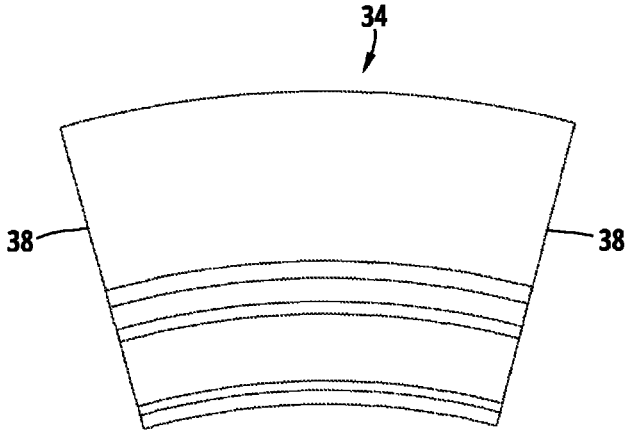
FIG. 3 is a front elevational view of a turbine shroud segment shown in FIG. 2.

Each shroud segment 34 includes an arcuate body 36 extending between end faces 38 (see FIG. 3) and having forward and aft ends 40 and 42. From rear to front the body 36 includes a first leg 44 which extends at an acute angle to the centerline axis A, a second leg 46 which also extends at an acute angle to the centerline axis A, a third leg 48 extending generally radially inward from the second leg 46, and a fourth leg 50 extending generally axially forward from the third leg 48. The first leg 44 and the second leg 46 meet in a shallow "V" angle with the apex of the V facing radially outwards.

The forward end of the second leg 46 overhangs the third leg 48 in the axial direction so that the two define a forward flange 52. Also, a boss 54 is disposed adjacent the intersection of the first and second legs 44 and 46 and includes a radially-outward-facing groove 56 formed therein.

Figure 5:
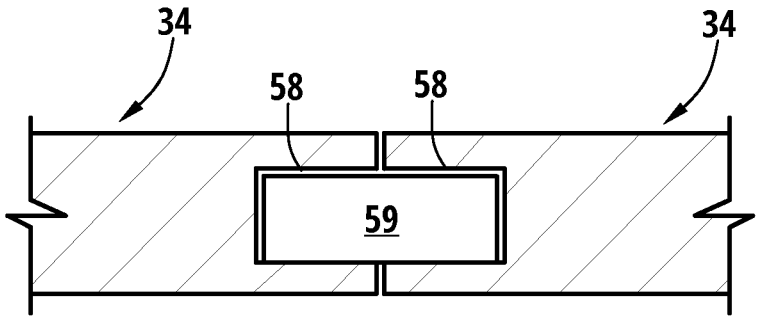
FIG. 5 is a cross-sectional view of a portion of two side-by-side shroud segments, showing a spline seal installed therein.

At the end faces 38, each of the legs 44, 46, 48, and 50 includes a slot 58 sized and shaped to receive a conventional spline seal 59 (seen in FIG. 5). A spline seal takes the form of a thin strip of metal or other suitable material which is inserted in slots 58. The spline seals span the gaps between shroud segments 34.

A stationary seal member 60 is mounted to the radially inner face of the body 36. The seal member 60 serves the purpose of forming a non-contact rotating seal in conjunction with the seal teeth 32. The seal member 60 is configured so as to be sacrificial in the even of contact with the seal tooth 32 during operation, an event known as a "rub". Various types of sacrificial materials exist, such as nonmetallic abradable materials and honeycomb structures.

Figure 4:
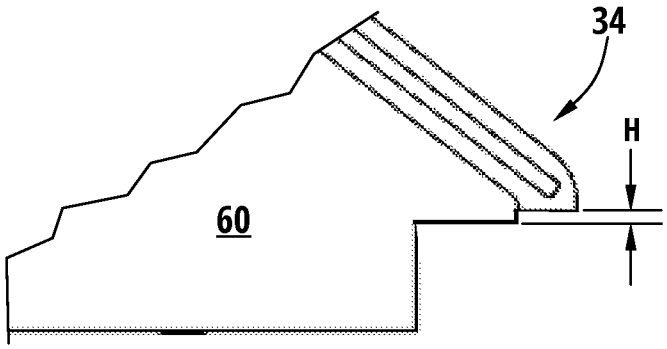
FIG. 4 is a side view of a portion of the shroud segment shown in FIG. 2.

In the illustrated example, the seal member 60 comprises a known type of metallic honeycomb structure comprising a plurality of side-by-side cells, extending in the radial direction. The seal member 60 has a back surface which conforms to the inner surface of the body 36. It also includes a flowpath surface 62. The flowpath surface 62 comprises a plurality of cylindrical sections that define a stepped profile, with the surface of each "step" being selected to provide a desired clearance to the adjacent seal tooth 32. At the aft end of the body 36, the seal member 60 extends radially inward beyond the first leg 44 of the body 36, so as to create a slight interference fit, as described in more detail below. The height "H" of the overhang is shown in FIG. 4, greatly exaggerated for illustrative purposes.

Referring back to FIG. 2, a nozzle is positioned downstream of the rotor, and comprises a plurality of circumferentially spaced airfoil-shaped vanes 64, each of which terminates at an arcuate tip shroud 66. Arcuate forward and aft hooks 68 and 70 extend outward from the tip shroud 66. The forward hook 68 extends axially forward and radially outward, and includes a flange 72 extending axially forward at its distal end.

An annular casing 74 surrounds shroud segments 34 and the vanes 64. The casing 74 includes an annular mounting slot 76 which faces axially aft, and also an annular mounting hook 78 with an L-shaped cross-sectional shape. The forward flange 52 of the shroud segment 34 is received in the mounting slot 76. The slot 56 of the boss 54 receives the mounting hook 78.

The forward hook 68 of the vane 64 is received in a slot defined by the mounting hook 78. When assembled, the tip shroud 66 of the vane 64 bears radially outward against the shroud segment 34.

The radial distance between the mounting hook 78 and the tip shroud 66 is selected such that the tip shroud 66 creates a slight interference fit with the stationary seal member 60. The seal member 60 compresses to accommodate this interference, creating a reliable seal against air leakage and holding the shroud segment 34 firmly against the mounting hook 78.

The addition of spline seals on the first leg 44 of the shroud segment 34 and the interference of the tip shroud 66 allows for very little leakage area through the backside of the shroud segment 34 and into the cavity in front of the forward leg of the nozzle. Additionally, the line of sight leakage from the flow path to the case mounting hook 78 is reduced or eliminated. The configuration as described herein will prevent gas path air from leaking over the forward leg of the tip shroud 66 and into the cavity between the shroud segment 34 and the nozzle. The sealing of this cavity from the hot gas path temperatures will protect the mounting hooks 78.

A technical advantage of this configuration is a reduction in leakage through the gaps and a reduction in air temperature in the cavity. The reduction in leakage and air temperature through the gaps will allow for better performance. Alternatively the reduction of air temperature in the cavity will help protect the case hooks from increased temperature and prevent cracking.

The foregoing has described a turbine shroud sealing configuration for a gas turbine engine. While specific embodiments of the present invention have been described, it will be apparent to those skilled in the art that various modifications thereto can be made without departing from the spirit and scope of the invention. Accordingly, the foregoing description of the preferred embodiment of the invention and the best mode for practicing the invention are provided for the purpose of illustration only and not for the purpose of limitation, the invention being defined by the claims.

What is claimed is:

1. A turbine shroud apparatus for a gas turbine engine having a centerline axis, comprising:

a shroud segment comprising:

an arcuate body extending axially between forward and aft ends and laterally between opposed end faces, wherein the body has a shape including first and second legs disposed in a V-shape and each of the end faces includes seal slots formed therein on at least the first and second legs, the first leg being disposed adjacent the aft end; and an arcuate stationary seal member mounted to the body;

a turbine vane disposed axially aft of the shroud segment; and a casing surrounding the shroud segment and the turbine vane;

wherein the turbine vane is mounted to the case so as to bear against the stationary seal member and the first leg, compressing the stationary seal member and forcing the shroud segment radially outward against the casing.

2. The apparatus of claim 1 wherein a boss is disposed at an intersection of the first and second leg and includes a radially-outward-facing groove formed therein.

3. The apparatus of claim 2 wherein:

the casing includes an annular mounting hook; and the mounting hook is received in the groove of the boss.

4. The apparatus of claim 1 wherein a forward end of the second leg overhangs a third leg in an axial direction so as to define a forward flange.

5. The apparatus of claim 4 wherein:

the casing includes an annular mounting slot; and the flange of the shroud segment is received in the mounting slot.

6. The apparatus of claim 1 wherein:

the turbine vane includes a tip shroud having a forward hook extending radially outward therefrom; and the forward hook is received in a slot defined by the mounting hook of the casing.

7. The apparatus of claim 1 wherein the stationary seal member comprises a metallic honeycomb structure.

8. A turbine shroud apparatus for a gas turbine engine having a centerline axis, comprising:

an annular array of rotatable turbine blades, each blade having an annular seal tooth projecting radially outward therefrom;

a shroud surrounding the turbine blades, the shroud comprising an annular array of side-by-side shroud segments, each shroud segment comprising:

an arcuate body extending axially between forward and aft ends and laterally between opposed end faces, wherein the body of each shroud segment has a shape including first and second legs disposed in a V-shape and each of the end faces includes seal slots formed therein on at least the first and second legs, the first leg being disposed adjacent the aft end; and an arcuate stationary seal member mounted to the body, wherein the end faces of adjacent shroud segments abut each other and at least one spline seal is received in the seal slots so as to span the gap between adjacent shroud segments;

an annular array of airfoil-shaped turbine vanes disposed axially aft of the shroud; and a casing surrounding the shroud segments and the turbine vanes;

wherein each of the turbine vanes is mounted to the case so as to bear against one of the stationary seal members and the first leg, compressing the seal member and forcing the associated shroud segment radially outward against the casing.

9. The apparatus of claim 8 wherein a boss is disposed at an intersection of the first and second legs and includes a radially-outward-facing groove formed therein.

10. The apparatus of claim 9 wherein:

the casing includes an annular mounting hook; and the mounting hook is received in the grooves of the bosses.

11. The apparatus of claim 8 wherein a forward end of the second leg overhangs a third leg in an axial direction so as to define a forward flange.

12. The apparatus of claim 11 wherein:

the casing includes an annular mounting slot; and the flange of each shroud segment is received in the mounting slot.

13. The apparatus of claim 8 wherein:

each turbine vane includes a tip shroud having a forward hook extending radially outward therefrom; and the forward hooks are received in a slot defined by the mounting hook of the casing.

14. The apparatus of claim 8 wherein each stationary seal member comprises a metallic honeycomb structure.

* * * * *

UNITED STATES PATENT AND TRADEMARK OFFICE

CERTIFICATE OF CORRECTION

PATENT NO. : 9,238,977 B2
APPLICATION NO. : 13/683813
DATED : January 19, 2016
INVENTOR(S) : Albers et al.

It is certified that error appears in the above-identified patent and that said Letters Patent is hereby corrected as shown below:

Specification

In Column 3, Line 21, delete "even" and insert -- event --, therefor.

In Column 3, Line 52, delete "slot 56" and insert -- slot 58 --, therefor.

Signed and Sealed this
Twenty-eighth Day of June, 2016

Michelle K. Lee

Michelle K. Lee
*Director of the United States Patent and Trademark Office*